US006256949B1

(12) United States Patent
Meierhofer

(10) Patent No.: US 6,256,949 B1
(45) Date of Patent: Jul. 10, 2001

(54) SUPPORTING WOODEN PANEL ELEMENT FOR CONSTRUCTING CEILINGS OR BRIDGES AND USE OF A SCREW FOR CONNECTING BOARDS TO FORM A PANEL ELEMENT

(75) Inventor: Ulrich A. Meierhofer, Wetzikon (CH)

(73) Assignee: SFS Industrie Holding AG, Heerbrugg (CH)

( * ) Notice: Subject to any disclaimer, the term of this patent is extended or adjusted under 35 U.S.C. 154(b) by 0 days.

(21) Appl. No.: 09/230,753

(22) PCT Filed: Aug. 7, 1997

(86) PCT No.: PCT/EP97/04297

§ 371 Date: Oct. 12, 1999

§ 102(e) Date: Oct. 12, 1999

(87) PCT Pub. No.: WO98/06912

PCT Pub. Date: Feb. 19, 1998

(30) Foreign Application Priority Data

Aug. 14, 1996 (DE) ..... 196 32 796

(51) Int. Cl.[7] ..... E04C 5/08

(52) U.S. Cl. ..... 52/223.1; 52/223.9; 52/223.8; 52/223.7; 52/796.1

(58) Field of Search ..... 52/796.1, 800.18, 52/585.1, 223.1, 223.4, 223.5, 223.6, 223.7, 223.8, 223.9, 223.14

(56) References Cited

U.S. PATENT DOCUMENTS

| | | | | |
|---|---|---|---|---|
| 1,944,237 | | 1/1934 | Heineman . | |
| 2,244,343 | * | 6/1941 | Meyercord | 52/585.1 |
| 2,439,655 | | 4/1948 | Graham . | |
| 3,172,170 | * | 3/1965 | Webster | 52/585.1 |
| 4,932,178 | * | 6/1990 | Mozingo | 52/223.7 |

FOREIGN PATENT DOCUMENTS

| | | |
|---|---|---|
| 842 709 | 6/1952 | (DE) . |
| 3117624 C2 | 10/1985 | (DE) . |
| 3408048 A1 | 11/1988 | (DE) . |
| 195 13 729 | 3/1996 | (DE) . |
| 295 02 068 U1 | 7/1996 | (DE) . |
| 1 404 294 | 11/1955 | (FR) . |

* cited by examiner

*Primary Examiner*—Christopher T. Kent
*Assistant Examiner*—Jennifer I. Thissell
(74) *Attorney, Agent, or Firm*—Volpe and Koenig, P.C.

(57) ABSTRACT

In a wooden panel element (1) for ceiling structures or for bridge construction there is provided a plurality of boards (25) standing on edge perpendicular to the plane of the panel element (1) and running along the entire length thereof, which boards are joined together by screw fastenings. The individual boards (25) are joined together at least partly by screws (27) driven at an acute angle to the surface thereof, each of these screws (27) passing through two successive boards (25). Also provided close to the upper edge (30) and the lower edge (31) of the boards (25) are screws (28) driven at right angles to the surface (26) of the boards (25).

14 Claims, 3 Drawing Sheets

SUPPORTING WOODEN PANEL ELEMENT FOR CONSTRUCTING CEILINGS OR BRIDGES AND USE OF A SCREW FOR CONNECTING BOARDS TO FORM A PANEL ELEMENT

The invention relates to a load-bearing wooden panel element for ceiling structures or for bridge construction, comprising a plurality of individual layers of boards standing on edge perpendicular to the plane of the panel element and preferably running along the entire length thereof, which boards are joined together by screw fastenings, and it further relates to the use of a screw for joining boards as a panel element.

The oldest and most familiar way of fastening board stacks is by nailing. In nailing, the forces between the boards are transferred by shearing in the nails and by hole-widening pressure between nail and wood. This kind of joint is relatively compliant and therefore of only limited effectiveness. Heretofore, prior art applications of screwed board stacks have depended on a principle of action analogous to nailing, or in other words shearing and hole-widening pressure.

There have already been published load-bearing panel elements (U.S. Pat. No. 1,944,237) in which a plurality of boards standing on edge are joined together by tie rods passing through all boards. In addition, the individual boards are joined together by nailing so that they are temporarily held mutually together during construction of such a stack. In the so-called transversely prestressed board stacks, the forces between the individual boards are transferred by friction, which presupposes a steady contact pressure. The transverse prestress therefore must always be guaranteed up to a certain level. Since wood has a tendency to shrinkage and creep deformations, it must be constantly ensured that the tension rods can be retightened.

In such a load-bearing wooden panel element, it is essential that the individual layers of boards be mutually firmly braced or be mutually firmly pressed, in order that they can better absorb the load. It must be realized in this known embodiment that only a certain number of boards standing on edge can be joined together as a panel element by tension rods. Thus it is not possible to make arbitrary widths of such panel elements, for example for use in ceiling structures or in bridge construction, and so individual panel elements, which are no longer joined together, are then disposed next to each other.

There have also been published other design variants for nailed, beam-like wooden structural members (DE C 842709) and for board-stack elements (DE A 19513729), in which individual boards are joined together as one element by nailed and/or screwed joints.

The object of the present invention is now to provide a load-bearing wooden panel element of the type mentioned in the introduction, which can be made with arbitrary length and width, wherein the forces occurring on individual layers of boards during loading of this panel element can be transferred to the greatest possible width of the panel element According to the invention, it is proposed for this purpose that the individual boards be joined together at least partly by screws driven at an acute angle to the surface thereof and disposed at least approximately in a plane running transverse to the longitudinal extent of the panel element, which screws pass through at least two successive boards.

By these features according to the invention, the situation is achieved that the occurring forces are transferred to a plurality of layers of boards disposed next to each other, even in the case of point-like or small-area loading of such a panel element, since the successive layers of boards are joined together in, so to speak, hook-like manner by the screws driven at an acute angle. Moreover, it is achieved by the use of screws that the successive layers of boards are effectively held and braced mutually. Thus, even in the case of possible shrinkage or expansion of the natural wood product, no change of the mutual fastening of the boards is necessary, since these always remain intimately and intensively joined to each other. By virtue of the special arrangement of the screws, these should be stressed primarily in longitudinal direction, or in other words by tension or compression, thus ensuring great effectiveness with respect to load-bearing capacity and stiffness.

It is further proposed that, in successive boards or in every second board, screws with crosswise directions be driven into successive planes separated by a spacing and disposed perpendicular to the boards. This feature offers the guarantee that in precisely these fastening zones, each layer of board is for practical purposes attached on both sides to the neighboring board by a hook-like arrangement, so that it can transfer large forces to a large area of a panel element.

In order to create even more fastenings between the individual boards in addition to this special mutual fastening for extensive transmission of forces, it is proposed that, in addition to the screws driven at an acute angle to the surface of the boards, further screws be used which are driven at right angles to the surface of the boards, each of which screws passes through at least three successive boards. By these additionally driven-in screws it is achieved that joining of the successive layers of boards takes place almost in the manner of a truss, specifically since the screws driven at an acute angle and at right angles complement each other.

In this connection it is advantageous for the screws driven at right angles to the surface of the boards to be driven alternately into every second board and to pass through three layers of boards. This creates the possibility of a repeatedly overlapping fastening between the individual boards since, for example, the screws driven at an acute angle pass through two boards and the screws driven at right angles each pass through three layers of boards. In this way optimal force transfer to large areas of the wooden panel element can be achieved.

In one advantageous embodiment is it provided that screws driven in pairs at an acute angle and at fight angles to the surface of the boards are disposed successively at a predetermined grid pitch and in two planes separated by a small spacing. Thereby pairs of successive fastener planes separated by a small spacing are then practically always created at specified spacings, in order in this way to achieve the optimum in mutual joining of the boards and in the capability of mutual force transfer.

In this connection, it is advantageous for the screws in one of the planes disposed at the grid pitch always to be driven to be inclined at an acute angle in one direction and those in the other plane to be inclined at an acute angle in the opposing direction, the two screws in each pair being driven crosswise relative to each other at the respective surfaces of boards fitting the grid pitch, but being disposed in successive planes separated by a small spacing. During construction of the panel element, therefore, two screws are practically always driven at an acute angle into planes disposed next to each other but separated by a small spacing, one directed obliquely from top to bottom and the other obliquely from bottom to top. In this case two fastening planes are always present next to each other in the manner of trusses, so to speak, thus ensuring optimal mutual joining of the individual boards as a panel element and optimal transfer of forces.

In this connection, it is advantageous precisely in the sense of forming truss-like fastening planes for screws inclined at an acute angle in the one direction to be provided in a plane fitting the corresponding grid pitch relative to the length of the panel element and, furthermore, for screws driven at right angles to the surface of the boards to be provided close to the top and bottom board edge. In this way, top and bottom tension or compression elements are formed practically transverse to the longitudinal extent of a panel element, and load-bearing elements are produced by screws inclined at an acute angle therebetween. Since the two screws driven at an acute angle are additionally disposed crosswise, two load-bearing zones interacting with each other are created in the immediately successive planes fitting to the grid pitch.

It is advantageous, and is also favorable from the assembly viewpoint, for the screws driven to be inclined at an acute angle to the surface of the boards to include an angle of approximately 45° with the surface, so that the screws disposed crosswise relative to each other in the closely successive planes form right angles with each other. Thereby the optimum capability for mutual force transfer between the successive boards can be achieved.

An advantageous embodiment provides that screws oriented at right angles to the surface of the board are driven into every second of the successive boards, each screw driven successively into every second board at right angles to the surface being paired with the other screw of the plane disposed therebeside at a small spacing therefrom. This offers the possibility that the screws driven at right angles to the surface overlap each other by a corresponding extent in the immediately adjacent planes without providing a continuous fastening. The screws driven at right angles to the surface form a kind of clamping element of known type passing through the entire width of the panel element, except that in this case there are used only short screws, disposed in parallel and overlapping each other alternately at their ends. In this way, however, they are distributed continuously over the entire width of the load-bearing panel element.

A particularly advantageous embodiment is achieved when the screws driven at an acute angle to the surface of the boards and the screws driven at right angles to the surface of the boards have the same length, in which case the screws driven at an acute angle each pass through two neighboring boards and the screws driven at right angles to the surface of the boards each pass through three successive boards. By this feature there is needed only one design of a screw, which can be used both for driving in at an acute angle and for driving in at right angles to the surface. Since only a single fastening element is necessary, assembly of the panel element therewith is made substantially easier.

An embodiment which is advantageous in particular for assembly of the panel element provides that fixing screws for temporary mutual fixation of successive boards are driven mid-way relative to the grid pitch and also relative to the height of the panel element. The fixing screws provided in this case hold the successive boards until the screws driven at an acute angle and at right angles to the surface have been placed. These fixing screws, provided as an assembly aid, remain in the load-bearing panel element but do not influence the load-bearing capability of the panel element.

The screw used according to the invention is characterized in that a threaded portion is provided on a shank at least at the two end regions thereof, in which case the two threaded portions are matched to each other in their course, or one continuous threaded portion is provided over the entire length, or else two successive portions of different diameters but having the same thread pitch are provided.

To obtain a load-bearing wooden panel element with appropriate load-bearing capability, it is necessary to use a corresponding screw, in which connection corresponding forces can be transferred precisely by a relatively long thread engagement. The manufacturing capabilities for long threads are limited to a certain size for the most part. However, options exist for providing two threaded portions. By means of the design comprising one continuous thread, the inherently simplest embodiment is created, in which case, however, an appropriate structural geometry must be provided for the drive of a driving tool. In precisely such a situation, however, it is then necessary under certain circumstances to have a certain diameter available, in order to be able to transmit the necessary torque with the driving tool. Another possibility, however, is to provide the drive for a driving tool in a shank portion of larger diameter. If the thread of the portion with the larger diameter is to engage in the already existing thread with the smaller diameter, however, then the two threaded portions must be matched to each other.

One possibility of how an exactly continued thread flight on a larger portion with the same thread pitch can be avoided in the small and in the large portion exists when the portion with the larger diameter has a core diameter corresponding at least approximately to the outside thread diameter of the portion with the smaller diameter. Then the same thread pitch is indeed present both in the portion with the larger diameter and in the portion with the smaller diameter, without it being necessary that the thread on the portion with the larger diameter begin exactly by a multiple of the thread pitch of the thread with the smaller diameter. In such an embodiment, the thread that has been formed by the portion with smaller diameter is practically already destroyed by the core diameter of the portion with the larger diameter and a new thread is formed in the board.

Precisely for the screws used according to the invention is it useful for a recessed drive to be provided for a driving tool at the free end of the portion with larger diameter. Thereby the possibility exists of using practically a headless screw, so that it is not necessary to countersink the screws. Thus the screws can always be driven sufficiently far that they are positioned under the surface of the corresponding board, so that the next board can again be placed flush for further assembly.

Further features and particular advantages according to the invention will be explained in more detail in the following description with reference to the drawings, wherein.

Figure 1:
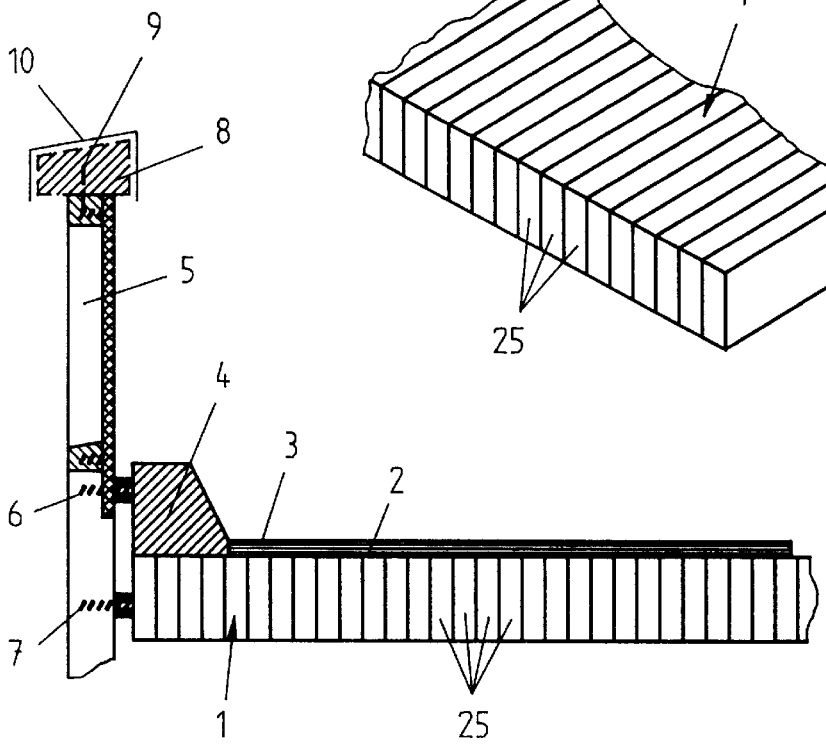
FIG. 1 shows a section through a partial structure of a bridge built with the panel element according to the invention.
Figure 2:
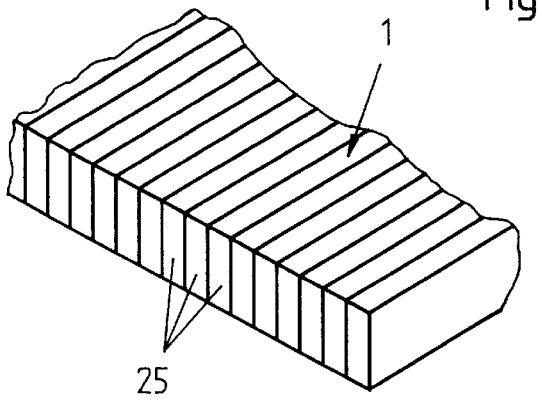
FIG. 2 shows an oblique view of a partial section of a panel element.
Figure 3:
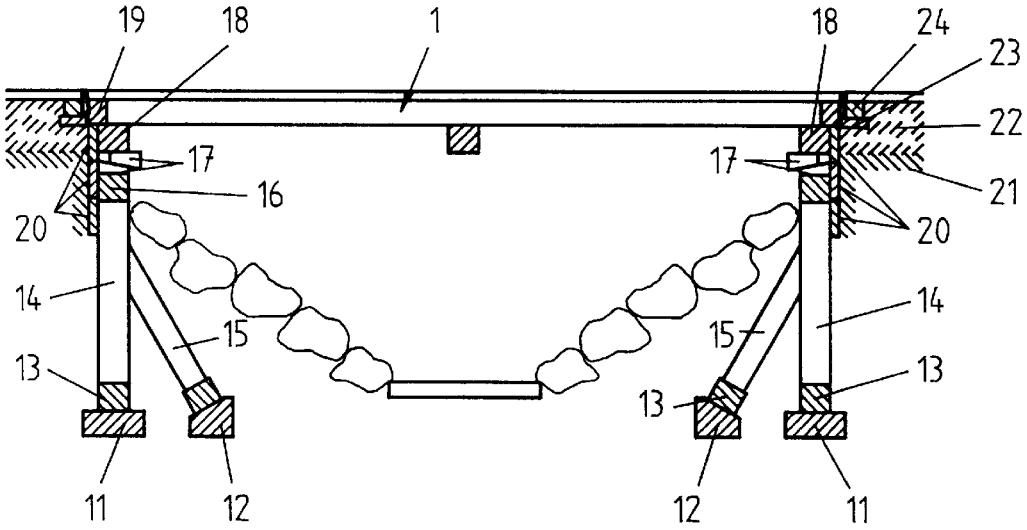
FIG. 3 shows a section through the entire structure of a bridge constructed with the panel element according to the invention.

FIG. 1 and 3 illustrate one possible structure of a wooden bridge. The bridge slab is formed from a load-bearing wooden panel element 1, the design and structure of which will be further explained hereinafter. On panel element 1 there is applied a moisture insulation 2, over which the bridge liner 3 is, then laid. The curb 4 is also made of wood. To this curb 4 and to the side edges of panel element 1 there are fastened railing posts 5 by bolts 6 and 7. To railing posts 5 there is attached and fastened by screws 9 a handrail 8, which can also be made of wood. The handrail 8 can additionally be provided with a copper covering 10. FIG. 3 illustrates a section through such a bridge in its longitudinal extent. Wooden ground beams 13 are seated on corresponding foundation parts 11, 12. Bearing beams 16 are braced by appropriate uprights 14 and struts 15. The actual beams 18 forming the bracing can be vertically adjusted by wedges 17. Panel element 1 then rests on beam 18. The continuing road is attached to appropriate connecting beams 19. Planks 20 standing on edge are provided to form a boundary to the solid material, while an appropriate boundary between the fastened part and the creek bed to be bridged is provided by an appropriate backing 21, excavation 22 and a cut-off sill placed on a foundation 23.

The load-bearing panel element 1 according to the present invention can be used not only for bridge construction but also for ceiling structures and naturally also for construction of walls or similar structures if necessary. Each panel element comprises a plurality of individual layers of boards 25 standing on edge perpendicular to the plane of the panel element 1 and preferably running along the entire length thereof. Maximum strengths are achieved when the boards are each made continuously over the entire length of the panel element For certain applications—especially for longer elements—it would also be possible, however, to provide, in addition to or instead of continuous boards, boards which are partly or completely continuous only over part of the length of the panel element, and which are then joined appropriately together. For example, it would also be possible to provide a plurality of shorter elements, which nevertheless overlap repeatedly in the individual layers. Within the scope of the invention it is entirely possible to use adhesives such as glue in addition to the screw fastenings. By virtue of the features according to the invention, however, this is not necessary for mutual joining of boards 25 as a panel element.

The features according to the invention now lie in the special fastening of the individual boards 25 to form the load-bearing wooden panel element. The individual boards 25 are joined together by screws 27 driven at an acute angle to the surface 26 thereof, these screws driven at an acute angle being positioned at least approximately in a plane running transverse to the longitudinal extent of panel element 1. In the inserted position, screws 27 are therefore driven to run obliquely from top to bottom or from bottom to top. As can be seen from the schematic diagram in FIG. 4, screws 27 pass through at least two successive boards 25. In successive boards 25 or if necessary only in every second board 25, screws with crosswise directions are driven into successive planes 29 and 39 separated by a spacing and disposed transverse to boards 25.

In addition to the screws 27 driven at an acute angle to the surface 26 of the boards 25, there are provided further screws 28 which each pass through at least three successive boards 25 and are inserted at right angles to the surface 26. In this connection, the screws 28 are so disposed, as can be seen in particular from FIG. 4 and 6, that they are driven alternately into every second board 25 and pass through three layers each of boards 25. Pairs of screws 27 and 28 driven respectively at an acute angle and at right angles to the surface 26 of the boards 25 are provided successively at a predetermined grid pitch R and in two planes 29, 39 separated from each other by a small spacing A.

Figure 7:
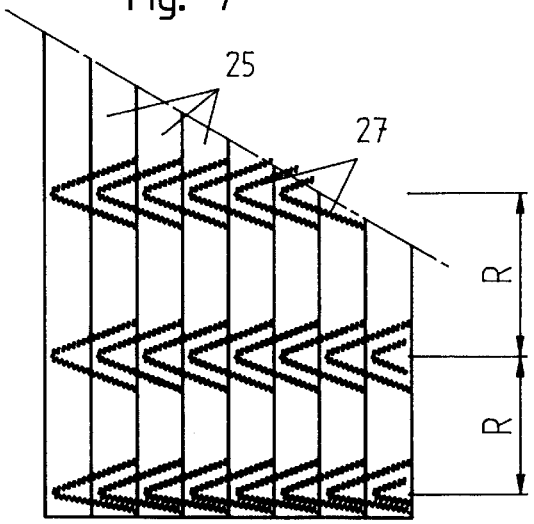
FIG. 7 shows a similar top view of a section of the panel element, wherein the screws driven at an acute angle are schematically illustrated.

As regards FIG. 7, it can be stated that the orientations shown therein of the screws 27 driven at an acute angle are chosen merely for carity. Viewed from above, the screws 27 would lie practically in one plane in one direction, and therefore would be disposed one above the other in this view, thus making a clear understanding impossible. The special method of illustration in FIG. 7 was chosen in order to make it clear that, in this embodiment, the screws 27 driven at an acute angle to the surface 26 pass through two boards and are inserted practically starting from the surface of each board.

The screws 27 disposed in one of the two planes 29, 39 are always driven to be inclined at an acute angle in one direction, and the screws disposed in the other plane 29, 39 are inclined at an acute angle in the opposing direction. Thus pairs of screws 27 disposed crosswise are provided at each surface 26 of boards 25 fitting the grid pitch R, but they occupy successive planes 29 and 39 separated from each other with small spacing A.

In each plane 29 or 39 there are provided, at the corresponding grid size R relative to the length of panel element 1, screws 27 inclined at an acute angle in one direction and, furthermore, screws 28 driven at right angles to the surface 26 of the boards 25, close to the upper board edge 30 and to the lower board edge 31. A truss-like arrangement of screws 27 and 28, each with spacing A, is practically created, and so optimal mutual fastening and load distribution is possible. As shown in particular by FIG. 4 and 9, the screws 27 driven to be inclined at an acute angle to the surface 26 of boards 25 include an angle a of approximately 45° with the surface 26, and so the screws 27 disposed crosswise relative to each other in the closely spaced successive planes 29, 39 are oriented at right angles to each other.

Figure 4:
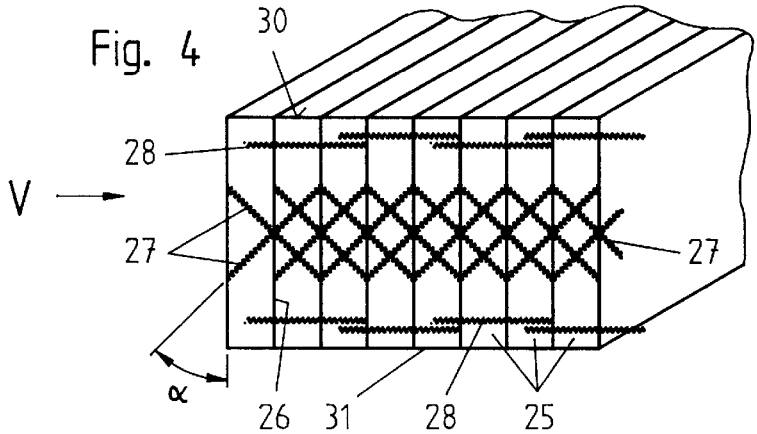
FIG. 4 shows a vertical section through the panel element along line IV—IV in FIG. 2 with schematically illustrated arrangement of the inserted screws.
Figure 6:
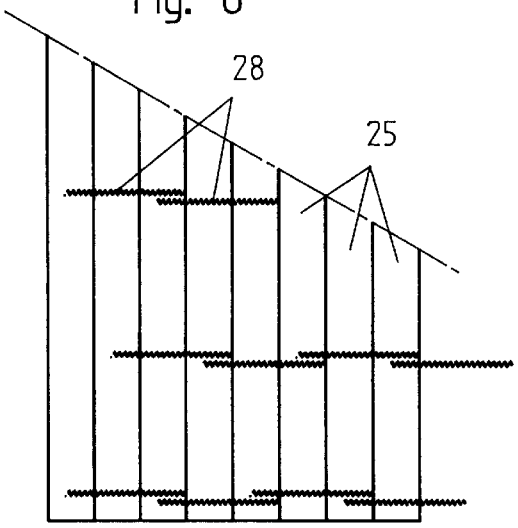
FIG. 6 shows a top view of a section of a panel element, wherein the screws driven at a right angles the surface of the boards are schematically illustrated.

As specially illustrated in FIG. 6, and also in FIG. 4, screws 28 oriented at right angles to the surface 26 are driven into every second one of the successive boards 25, each screw 28 driven into every second board 25 paired with the other screw of the plane 29 or 39 disposed therebeside at a small spacing A therefrom. The screws 28 therefore overlap repeatedly at their end regions, although this overlap is separated by the spacing A of the two planes 29, 39.

It is particularly advantageous for the screws 27 driven at an acute angle and the screws 28 driven at right angles to have the same length. The screws driven at an acute angle then pass through two neighboring boards 25 and the screws driven at right angles each pass through three successive boards 25. The unique advantage, however, lies in the fact that the same screws can always be used for the application of screws 27 and the application of screws 28. In all cases, therefore, only one kind of screw is necessary for assembly of such a panel element, and the same design and length will be chosen if possible for the screws additionally required for constructing a bridge.

The grid pitch R is adapted according to the unsupported bearing length of the panel element, and the spacing A of the two planes 29 and 39 can also be adjusted to the various circumstances. Criteria for special adaptation can include, for example, the span of such a panel element, the particular load-bearing capacity of the panel element, the type of wood used, and also the type of screws used.

Figure 5:
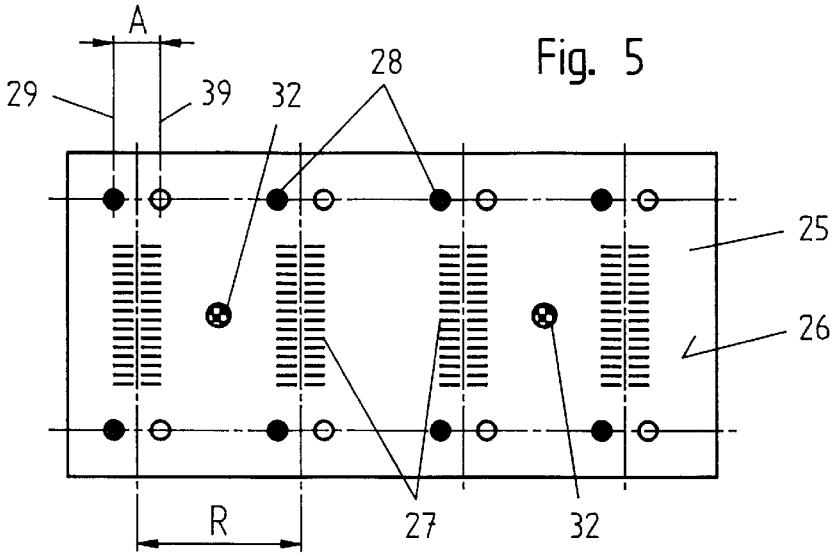
FIG. 5 shows a view of the surface of a board in use with schematically illustrated arrangement of the inserted screws.

FIG. 5 shows that fixing screws 32 for temporary mutual fixation of successive boards 25 are driven mid-way relative to the grid spacing R and also relative to the height H of panel element 1. The fixing screws 32 constitute a kind of assembly aid in constructing the panel element, in that the next board can be firmly joined to the preceding board or to the already completed section of the panel element at certain spacings, thus making it easier to drive screws 27 and 28. Naturally the fixing screws do not always have to be disposed mid-way relative to a grid pitch and mid-way relative to the height H. Thereby it is merely ensured that the fixing screws 32 are not disposed in the region of or close to the planes 29 and 39.

Figure 8:
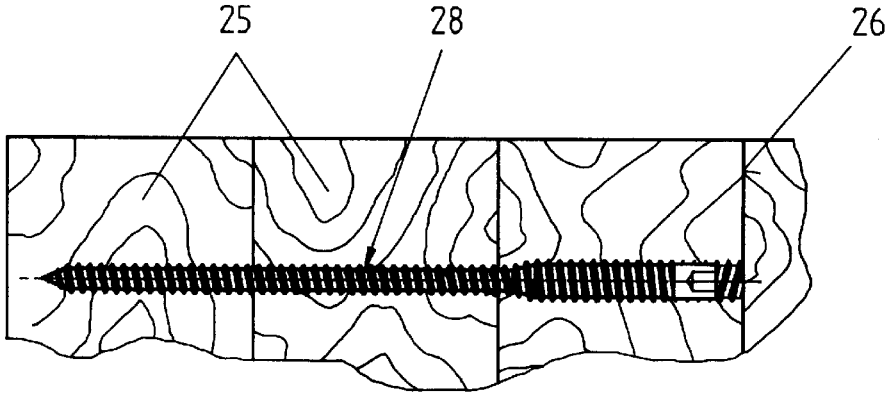
FIG. 8 shows a vertical section through a partial region of the panel element in which an inserted crew is driven at right angles to the surface of a board.
Figure 9:
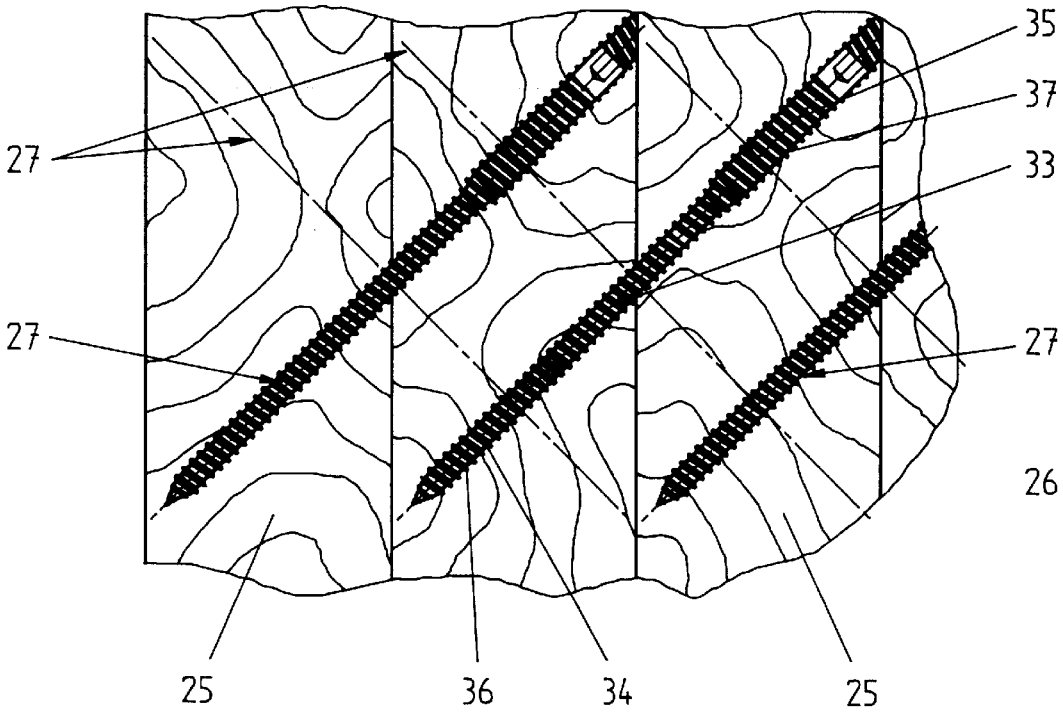
FIG. 9 shows a vertical section through a panel element in the region of screws driven at an acute angle to the surface of the boards.

The diagrams of FIG. 8 and 9 show a special embodiment of screws 27 and 28. On a shank 33 there are provided two portions 34 and 35 of different diameter, each with a threaded portion 36, 37. The two threaded portions have the same thread pitch. Thereby mutual displacements of the successive boards 25 do not occur during the driving process. Moreover, it is ensured that the thread already cut by threaded portion 36 cannot be destroyed by threaded portion 37. In this connection, it is useful for the portion 35 with the larger diameter to have a core diameter corresponding at least approximately to the outside thread diameter of portion 34. Thereby it is also possible for the threaded portions 36 and 37 to have the same thread pitch, even though an exactly continuous thread does not have to be present over the entire length of the screw.

If instead of portions 34, 35 with different diameter there were present two threaded portions at least in the end regions, these threaded portions would have to be matched exactly to each other, so that the trailing threaded portion could begin to engage exactly in the thread already cut by the first threaded portion. For a shank 33 with continuously constant diameter and continuous thread, it is inherently clear that the same pitch is present throughout. It would also be inherently conceivable, however, for the two threaded portions 36 and 37 to have slightly different thread pitch, in which case the threaded portion 37, for example, could have a slightly smaller thread pitch. In such an embodiment, an additional effect could be achieved in that the two successive boards are correspondingly drawn toward each other and thus pressed against each other to achieve prestressed condition.

At the free end of the portion 35 with larger diameter there is formed a recessed drive 38 for a driving tool. Such a screw 27 or 28 therefore does not have a head projecting beyond the thread, and so no particular forces are needed to countersink the screw at the surface of the respective board. If the screws are to be countersunk only slightly, it is also possible to use screws with larger heads, thus permitting better leverage by the driving tool. Such screws can be provided with, for example, a countersunk head.

Within the scope of the invention, it would also be possible successively to dispose more than two portions 34, 35 of different shank diameter, if this would contribute to even better joining and mutual bracing of the successive boards 25.

It would also be conceivable to provide only one plane 29 or 39 of screws 27, 28 at the grid pitch R, in which case the screws 27 driven at an acute angle are inclined in opposing directions at every second grid pitch R.

The special advantages of the present invention lie in the fact that the assembly of a panel element can be achieved in simple manner on the spot, and that the successive boards of the panel element are always optimally braced against each other and thus can always be used for the best possible load distribution without the need for retightening of screwed joints.

What is claimed is:

1. A load-bearing wooden panel element for ceiling structures or for bridge construction, comprising a plurality of individual layers of boards standing on edge perpendicular to the plane of the panel element, which boards are joined together by screw fastenings, characterized in that the individual boards (25) are joined together at least partly by screws (27) driven at an acute angle to the surface thereof and disposed at least approximately in a plane running transverse to the longitudinal extent of the panel element (1), which screws pass through at least two successive boards (25).

2. A panel element according to claim 1, characterized in that, in successive boards (25) or in every second board (25), screws (27) with crosswise directions are driven into successive planes (29, 39) separated by a spacing (A) and disposed perpendicular to the boards (25).

3. A panel element according to claim 1, characterized in that, in addition to the screws (27) driven at an acute angle to the surface (26) of the boards (25), further screws (28) are used which are driven at right angles to the surface (26) of the boards (25), each of which screws passes through at least three successive boards (25).

4. A panel element according to claim 3, characterized in that the screws (28) driven at right angles to the surface (26) of the boards (25) are driven alternately into every second board (25) and each passes through three layers of boards (25).

5. A panel element according to claim 1, characterized in that screws (27, 28) driven in pairs at an acute angle and at right angles to the surface (26) of the boards (25) are disposed successively at a predetermined grid pitch (R) and in two planes (29, 39) separated by a small spacing (A).

6. A panel element according to claim 5, characterized in that the screws (27) in one of the planes (29, 39) disposed at the grid pitch (R) are always driven to be inclined at an acute angle in one direction and those in the other plane (29, 39) are inclined at an acute angle in the opposing direction, the two screws (28) in each pair being driven crosswise relative to each other at the respective surfaces (26) of boards (25) fitting the grid pitch (R), but being disposed in successive planes (29, 39) separated by a small spacing (A).

7. A panel element according to claim 6, characterized in that screws (27) inclined at an acute angle in the one direction are provided in a plane (29, 39) fitting the corresponding grid pitch (R) relative to the length of the panel element (1) and, furthermore, screws (28) driven at right angles to the surface (26) of the boards (25) are provided close to the top and bottom board edge (30, 31).

8. A panel element according to claim 1, characterized in that the screws (28) driven to be inclined at an acute angle to the surface (26) of the boards (25) include an angle (a) of approximately 45° with the surface (26), so that the screws (27) disposed crosswise relative to each other in the closely successive planes (29, 39) form right angles with each other.

9. A panel element according to claim 1, characterized in that screws (28) oriented at right angles to the surface (26) of the board (25) are driven into every second of the successive boards (25), each screw (28) driven successively into every second board (25) at right angles to the surface (26) being paired with the other screw of the plane (29, 39) disposed therebeside at a small spacing (A) therefrom.

10. A panel element according to claim 1, characterized in that the screws (27) driven at an acute angle to the surface (26) of the boards (25) and the screws (28) driven at right angles to the surface (26) of the boards (25) have the same length, in which case the screws (27) driven at an acute angle each pass through two neighboring boards (25) and the screws (28) driven at right angles to the surface (26) of the boards (25) each pass through three successive boards (25).

11. A panel element according to claim 1 or one of the preceding claims, characterized in that fixing screws (32) for temporary mutual fixation of successive boards (25) are driven mid-way relative to the grid pitch (R) and also relative to the height (H) of the panel element (1).

12. A screw for joining boards as a panel element according to claim 1, in which a threaded portion (36, 37) is provided on a shank (33) at least at the two end regions thereof, in which case the two threaded portions (36, 37) are matched to each other in their course, or one continuous threaded portion is provided over the entire length, or else two successive portions (34, 35) of different diameters but having the same thread pitch are provided.

13. A screw according to claim 12, in which the portion (35) with the larger diameter has a core diameter corresponding at least approximately to the outside thread diameter of the portion (34) which has the smaller diameter.

14. A screw according to claim 12, in which a recessed drive (38) is provided for a driving tool at the free end of the portion (35) with larger diameter.

* * * * *